US005651252A

United States Patent [19]

Ansart et al.

[11] Patent Number: 5,651,252

[45] Date of Patent: Jul. 29, 1997

[54] FUEL INJECTION ASSEMBLY FOR A GAS TURBINE ENGINE

[75] Inventors: Denis Roger Henri Ansart, Bois le Roi; Patrice André Commaret, Maincy; Denis Jean Maurice Sandelis, Nangis, all of France

[73] Assignee: Societe Nationale d'Etude et de Construction de Moteurs d'Aviation S.N.E.C.M.A., Paris Cedex, France

[21] Appl. No.: 601,446

[22] Filed: Feb. 14, 1996

[30] Foreign Application Priority Data

Feb. 15, 1995 [FR] France ..... 95 01706

[51] Int. Cl.[6] ..... F23R 3/32

[52] U.S. Cl. ..... 60/737; 60/739; 60/746; 60/748; 239/427

[58] Field of Search ..... 60/39.36, 737, 60/742, 746, 747, 748; 239/427, 427.3, 425, 424.5

[56] References Cited

U.S. PATENT DOCUMENTS

| | | | |
|---|---|---|---|
| 2,628,475 | 2/1953 | Heath . | |
| 2,949,012 | 8/1960 | Caruel . | |
| 3,570,242 | 3/1971 | Leonard et al. | 60/748 |
| 3,626,444 | 12/1971 | Caruel et al. . | |
| 4,255,122 | 3/1981 | Alpkvist et al. | 60/737 |
| 4,351,156 | 9/1982 | White . | |
| 5,133,192 | 7/1992 | Overton . | |
| 5,444,982 | 8/1995 | Heberling et al. | 60/737 |
| 5,540,056 | 7/1996 | Heberling et al. | 60/737 |

FOREIGN PATENT DOCUMENTS

| | | |
|---|---|---|
| 1590542 | 4/1970 | France . |
| 2691235 | 5/1990 | France . |
| 2695713 | 9/1992 | France . |

*Primary Examiner*—Charles G. Freay
*Attorney, Agent, or Firm*—Bacon & Thomas

[57] ABSTRACT

A fuel injection assembly for a combustion chamber of a gas turbine engine is disclosed in which a plurality of premixing chambers are in communication with the combustion chamber and adjacent pairs of the premixing chambers are connected to a single prevapoization chamber by prevaporization conduits. Fuel is injected into the prevaporization chamber via a fuel injector and is mixed with oxidizer passing into the prevaporization chamber such that the fuel/oxidizer mixture has a richness exceeding the stoichiometric ratio. The fuel/oxidizer mixture passes into the prevaporization conduits through a diaphragm opening and, upon entering the premixing chamber, is mixed with additional oxidizer such that the fuel/oxidizer mixture in each premixing chamber has a richness less than the stoichiometric ratio. The premixing chambers are bounded by generally tubular walls, a portion of each adjacent tubular wall forming a protective hood between the fuel injector and the combustion chamber so as to prevent self-ignition of the fuel/oxidizer mixture in the prevaporization chamber. Oxidizer entering the premixing chambers passes through one or more oxidizer swirlers to assure a complete mixing of the fuel and oxidizer prior to its passing into the combustion chamber.

14 Claims, 6 Drawing Sheets

FUEL INJECTION ASSEMBLY FOR A GAS TURBINE ENGINE

BACKGROUND OF THE INVENTION

The present invention relates to a fuel injection assembly for a gas turbine engine, more particularly such an assembly that minimizes the generation of nitrogen oxidizes and eliminates the possibility of self-ignition of the fuel/oxidizer mixer before passing into the combustion chamber.

French Patent 1,590,542 discloses a fuel injection assembly for a gas turbine engine which comprises a fuel injector injecting fuel into a prevaporization chamber and at least two prevaporization conduits connected to the chamber and to two intake orifices of different premixing chambers which issue into the combustion chamber. The prevaporization chamber is fitted with intake orifices for a pressurized prevaporization oxidizer and each premixing chamber has an intake device for dilution pressurized oxidizer.

The known fuel injection assemblies have not completely resolved the problems of excessive generation of nitrogen oxide ($NO_x$) and smoke, nor have they eliminated the danger of self-ignition of the fuel/oxidizer mixture, resulting in poor combustion control.

SUMMARY OF THE INVENTION

A fuel injection assembly for a combustion chamber of a gas turbine engine is disclosed in which a plurality of premixing chambers are in communication with the combustion chamber and adjacent pairs of the premixing chambers are connected to a single prevaporization chamber by prevaporization conduits. Fuel is injected into the prevaporization chamber via a fuel injector and is mixed with oxidizer passing into the prevaporization chamber such that the fuel/oxidizer mixture has a richness exceeding the stoichiometric ratio. The fuel/oxidizer mixture passes into the prevaporization conduits through a diaphragm opening and, upon entering the premixing chamber, is mixed with additional oxidizer such that the fuel/oxidizer mixture in each premixing chamber has a richness less than the stoichiometric ratio. The premixing chambers are bounded by generally tubular walls, a portion of each adjacent tubular wall forming a protective hood between the fuel injector and the combustion chamber so as to prevent self-ignition of the fuel/oxidizer mixture in the prevaporization chamber. Oxidizer entering the premixing chambers passes through one or more oxidizer swirlers to assure a complete mixing of the fuel and oxidizer prior to its passing into the combustion chamber.

The design according to the present invention eliminates self-ignition of the fuel/oxidizer in the prevaporization chamber and insures lean and complete combustion of the fuel/oxidizer in the combustion chamber, thereby reducing generation of nitrogen oxides and smoke. To achieve these goals, the cross-section of the intake orifices for the prevaporization oxidizer and the pressure of the prevaporization oxidizer are such that the richness of the prevaporized fuel/oxidizer mixture is higher than stoichiometric, whereas the intake cross-section for the dilution oxidizer and the pressure of the dilution oxidizer are such that the fuel/air mixture in each of the premixing chambers has a richness less than stoichiometric.

To further carry out the objects of the invention, the prevaporization conduits are connected in parallel to the prevaporization chamber and a diaphragm opening is located between the prevaporization conduits and the associated prevaporization chamber. A single diaphragm opening is located between the pair of prevaporization conduits and the prevaporization chamber.

The fuel injection assembly also comprises a hood protecting and insulating the fuel injector from the combustion chamber to prevent self-ignition of the fuel/oxidizer mixture in the prevaporization chamber. The protective hood has an opening enclosing the prevaporization oxidizer intake orifice of the prevapoization chamber and a second opening connected to a source of pressurized oxidizer. The opening extends around the prevaporization chamber in order to form an annular space through which the oxidizer may pass. The portions of the walls of the premixing chambers which form the protective hood are perforated with orifices issuing into the premixing chambers to permit the passage of dilution oxidizer.

Dilution oxidizer also passes into each premixing chamber through a helical intake swirler which is oriented coaxially with the premixing chamber intake through which passes the prevaporized fuel/oxidizer mixture. Each premixing chamber may contain a single helical swirler as well as additional dilution oxidizer intake orifices through other wall portions to provide a sufficient quantity of dilution oxidizer. Alternatively, the walls of the premixing chambers may be formed without orifices and a pair of coaxial helical swirlers are located coaxially with the premixing chamber intake to provide a sufficient quantity of dilution oxidizer. The walls of the premixing chambers are generally tubular and may converge in a direction toward the exhaust opening of the combustion chamber so as to have a generally frusto-conical configuration.

When utilized in a known dual-head injector, the fuel injection assembly according to the present invention may be utilized in either one of the dual heads, i.e. either the "low power" head or the "high power" head.

DETAILED DESCRIPTION OF THE PREFERRED EMBODIMENTS

Figure 1:
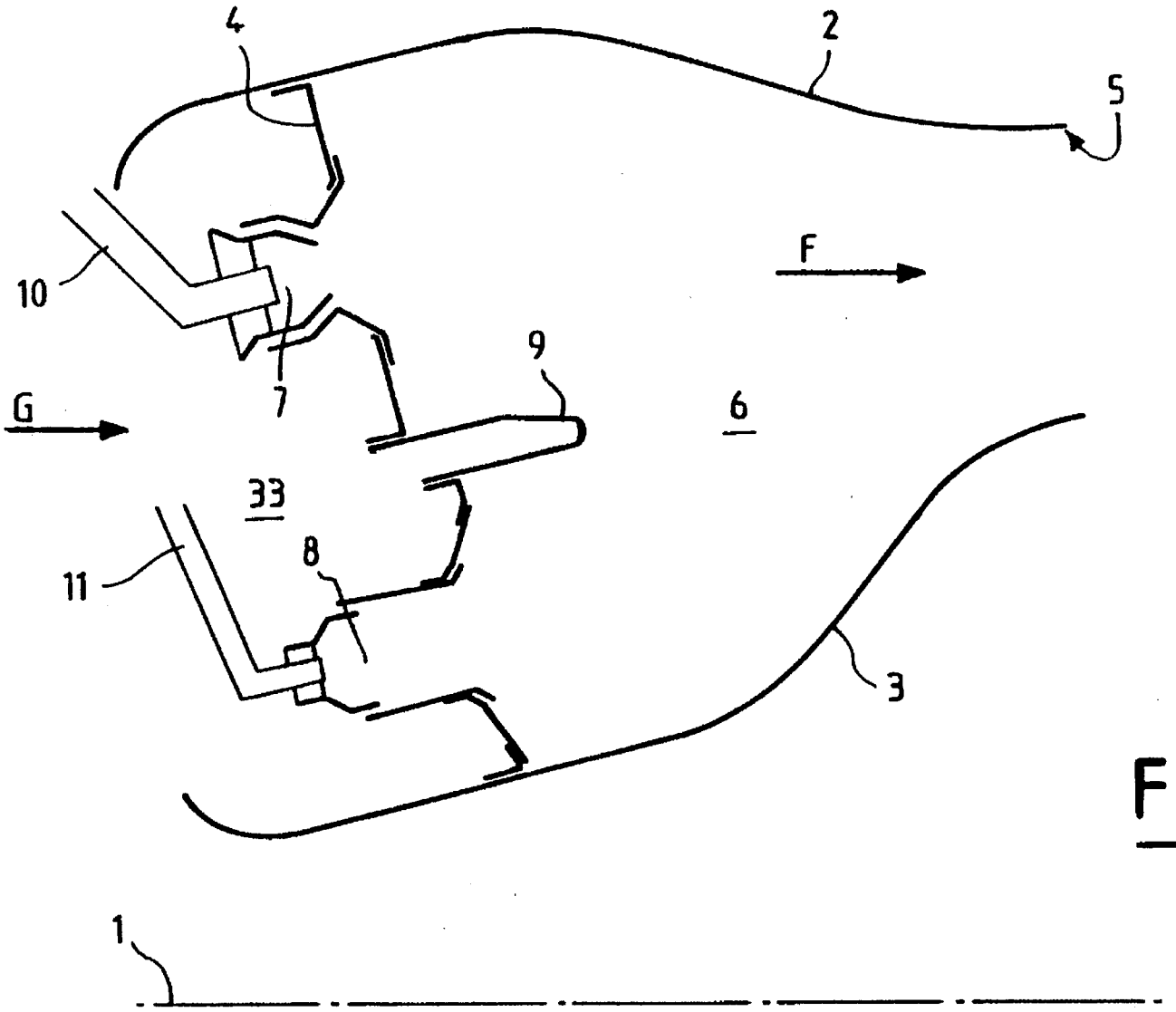
FIG. 1 is a partial, schematic, cross-sectional view illustrating a combustion chamber having a fuel injection assembly according to the present invention.

As best seen in FIG. 1, the combustion chamber 6 is bounded by an external wall 2 which extends in an annular fashion about the axis of symmetry 1, an inner wall 3 which also extends about axis 1 in annular fashion, and a transverse end wall 4 which interconnects the walls 2 and 3. End wall 4 is located generally upstream in relation to the gas flow direction, illustrated by arrow F, which passes outwardly through the exhaust opening 5. Accordingly, the combustion chamber 6 assumes an annular geometry about symmetrical axis 1.

A dual-head combustion chamber is illustrated in FIG. 1 and, in known fashion, an annular array of fuel injectors 7 operate during the low power operating mode of the engine while the annular array of fuel injectors 8 are used for full power operation of the engine, such as during aircraft take-off. The fuel injectors 7 are separated from the fuel injectors 8 by an intermediate separator 9 and each are respectively connected to a fuel supply by conduits 10 and 11. A pressurized oxidizer source, symbolically denoted by arrow G, feeds pressurized oxidizer to the combustion chamber, both to support the combustion of the fuel and to cool the walls of the various combustion chamber components exposed to the high combustion generated temperatures. Generally speaking, the pressurized oxidizer source comprises the gas turbine engine compressor located upstream of the combustion chamber and which is driven by the gas turbine.

Figure 2:
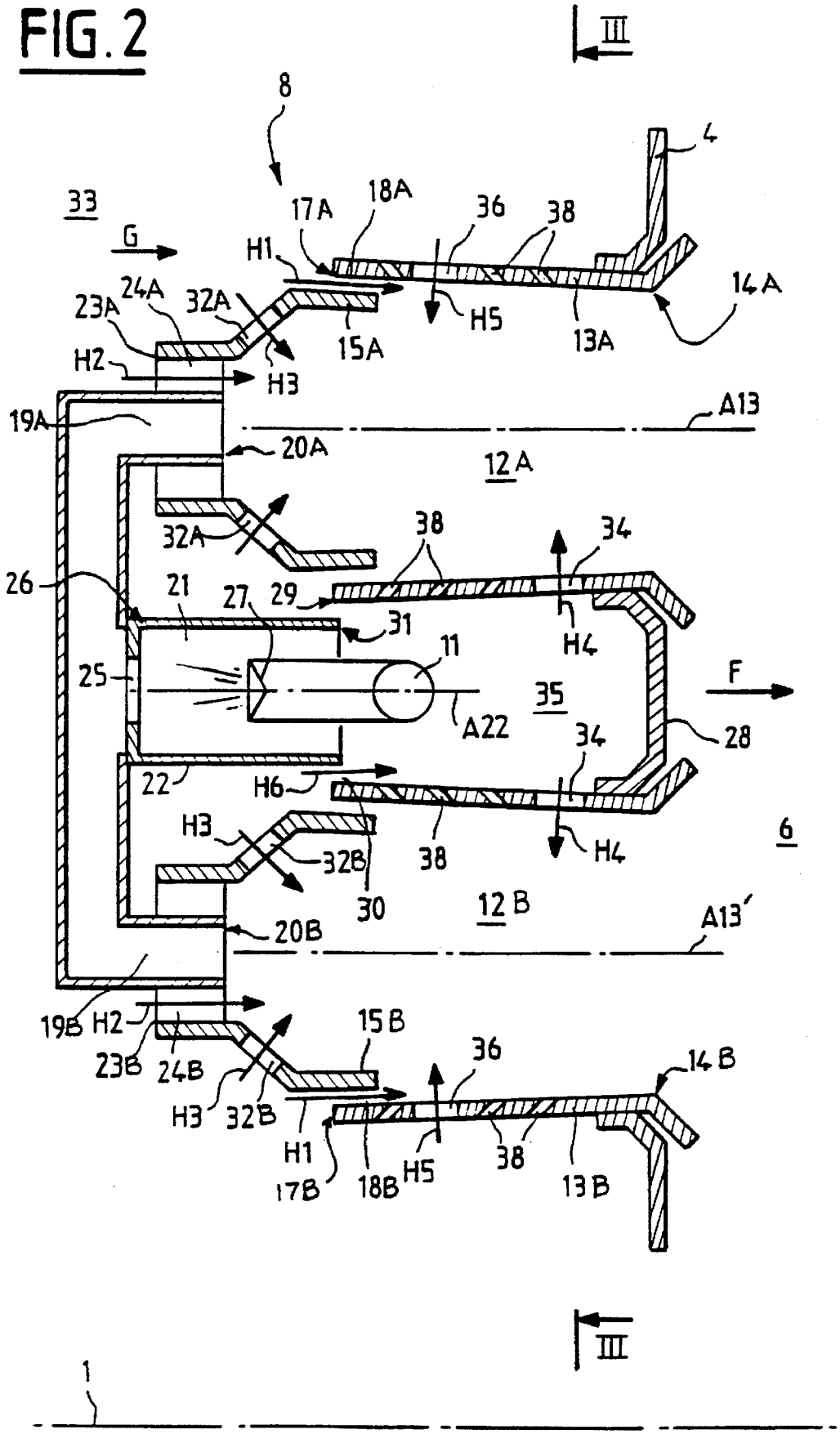
FIG. 2 is a longitudinal, partial, cross-sectional view of a first embodiment of the fuel injection assembly according to the present invention.
Figure 3:
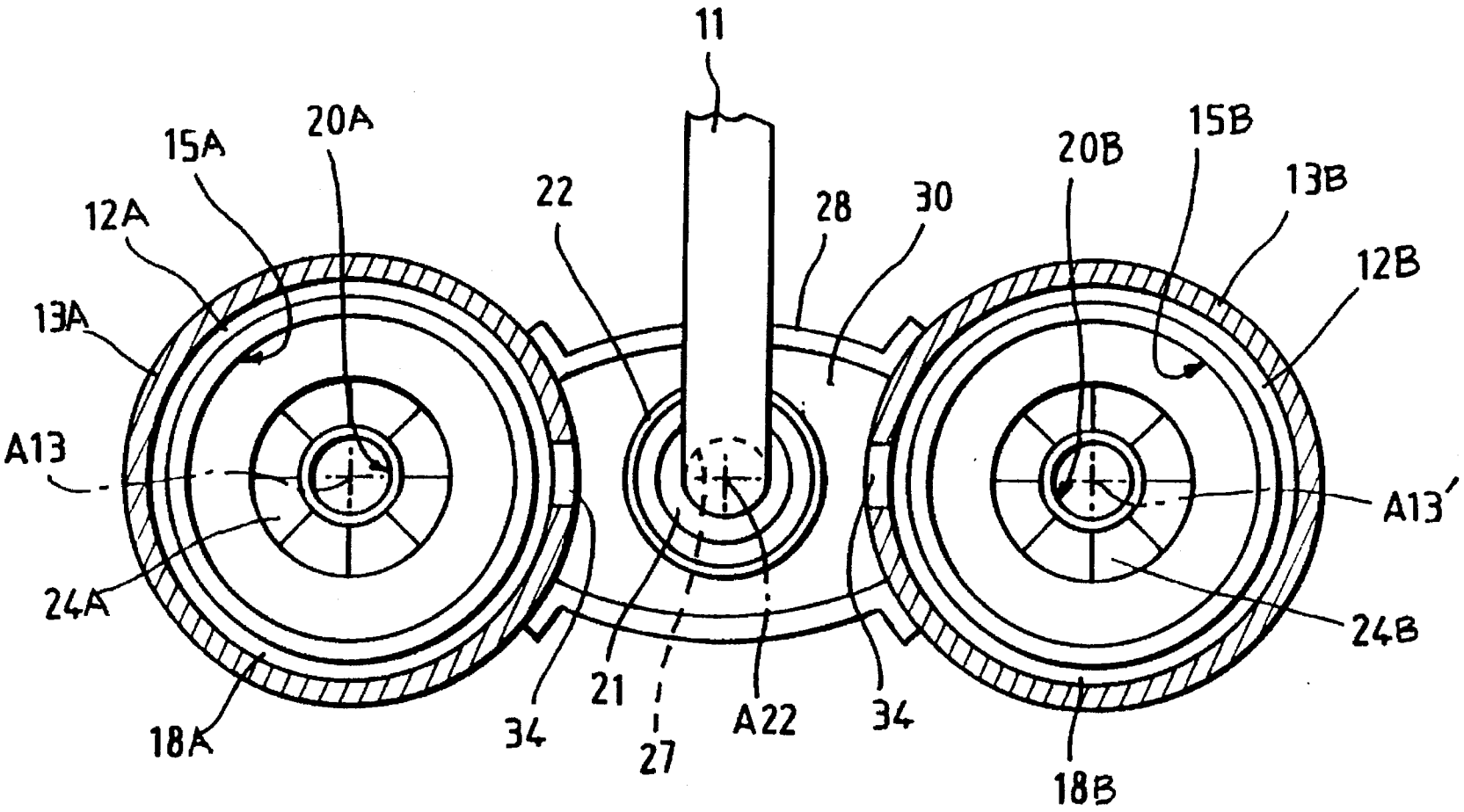
FIG. 3 is a cross-sectional view taken along line III—III in FIG. 2.

A first embodiment of the invention is illustrated in FIGS. 2 and 3. Two premixing chambers 12A, 12B are bounded by generally frusto-conical walls 13A, 13B which extend about axes A13 and A13', respectively, substantially parallel to the axis 1. The walls 13A, 13B are affixed to the combustion chamber end wall 4 and each converges in a downstream direction, in the direction of arrow F toward the exhaust 5 of the combustion chamber. The premixing chambers 12A and 12B have openings 14A, 14B which allow communication between the interior of the premixing chambers and the combustion chamber 6. Annular and generally hemispherical bodies 15A, 15B are located in the upstream end apertures 17A, 17B of each of the premixing chambers 12A, 12B such that annular intake spaces 18A, 18B are formed between the bodies 15A, 15B and the walls 13A, 13B so as to enable pressurized oxidizer to the flow into the premixing chambers 12A, 12B from space 33 as illustrated by arrow H1. Body 15A is coaxial about axis A13, while body 15B is coaxial about axis A13'.

Prevaporization conduits 19A, 19B are each connected to one of the bodies 15A, 15B into which they coaxially issue through premixing chamber intake orifices 20A, 20B, and to a prevaporization chamber 21. Prevaporization chamber 21 is bounded by a cylindrical wall 22 extending about axis A22 which extends substantially parallel to the axis 1. Helical "swirlers" 24A, 24B are located between the end of each prevaporization conduit 19A, 19B which terminates in the openings 20A, 20B and an upstream end opening 23A, 23B of the corresponding body 15A, 15B. The "swirlers" admit dilution oxidizer (indicated by arrows H2) into the premixing chambers 12A, 12B and impart a rotation to the dilution oxidizer passing through the swirlers to insure a homogenous mixing of the fuel/oxidizer mixture within the premixing chambers 12A, 12B. The structure of the swirlers 24A, 24B is well known and it is not believed necessary to provide further description here.

A diaphragm opening 25 is formed in the upstream end 26 of the prevaporization chamber 21 to enable communication between the interior of the prevaporization chamber 21 and the two prevaporization conduits 19A, 19B. A fuel supply conduit 11 is connected to the fuel injector 27 to enable fuel to be injected inside the prevaporization chamber 21 in an upstream direction (opposite the direction of arrow F) toward the diaphragm opening 25. A protective hood 28 extends between adjacent portions of walls 13A, 13B, to insulate and protect the fuel injector 27 from the combustion chamber 6. The upstream ends of the portions of walls 13A, 13B which form the protective hood define an opening 29 which encloses the downstream end 31 of the wall 22 forming the prevaporization chamber 2I so as to define therebetween an annular space 30. Annular space 30 enables oxidizer to pass into the interior of the protective hood 28, as well as into the prevaporization chamber 21, as illustrated by arrows H6.

In the embodiment illustrated in FIGS. 2 and 3, only one swirler 24 is associated with each of the intake openings 20. In this embodiment, dilution oxidizer is supplemented by orifices 32A, 32B extending through bodies 15A, 15B to enable oxidizer from the space 33 to pass into the premixing chambers 12A, 12B, as illustrated by arrows H3. The oxidizer also is supplemented by orifices 34 formed in those segments of walls 13A, 13B that define the protective hood 28 enabling oxidizer to pass into the premixing chambers 12A, 12B from the; interior 35 of the protective hood 28, as illustrated by arrows H4. Additional oxidizer enters the, premixing chambers 12A, 12B through orifices 36 formed in walls 13A, 13B which are located substantially opposite the orifices 34 to enable oxidizer to enter the premixing chambers 12A, 12B as illustrated by arrows H5.

Figure 4:
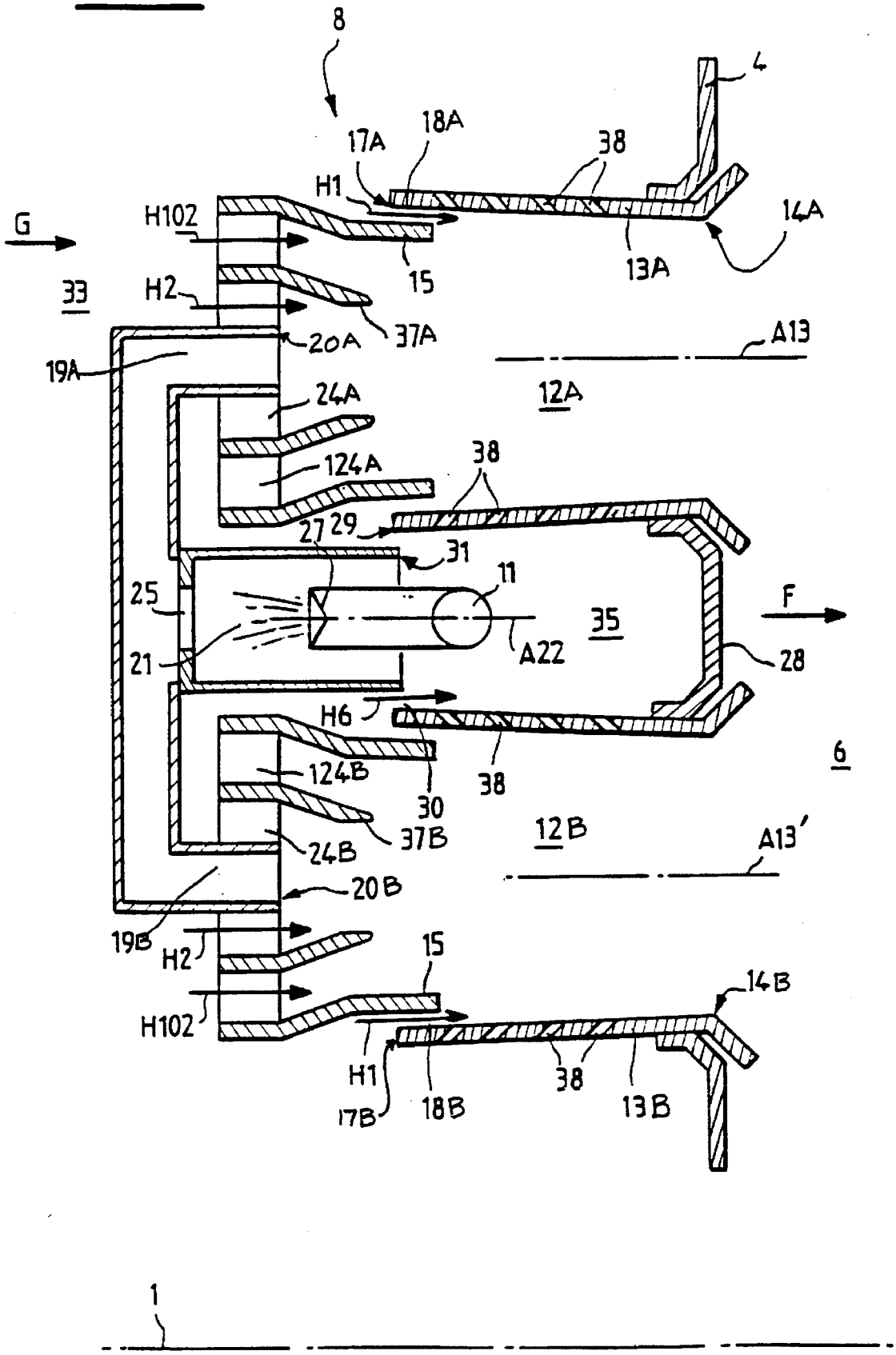
FIG. 4 is a partial, longitudinal cross-sectional view similar to FIG. 2, illustrating a second embodiment of the fuel injection assembly according to the present invention.

An alternative embodiment is illustrated in FIG. 4 which utilizes a pair of coaxial swirlers for each premixing chamber 12A, 12B. As illustrated therein, swirlers 24A, 24B are coaxially located within swirlers 124A, 124B and are located coaxially around the intake openings 20A, 20B of the premixing chambers 12A, 12B. In this particular embodiment, the dilution oxidizer orifices 32, 34 and 36 of the previous embodiment are eliminated. Separating walls 37A, 37B are located between the swirlers 24 and 124 for the purpose of initially separating the oxidizer flows H2, H102 entering the premixing chambers 12A, 12B through the swirlers. As can be seen, the walls 37A, 37B may converge in a direction towards the exhaust opening of the combustion chamber. Depending upon the criteria of each particular application, the swirlers 24, 124 may rotate the oxidizer in the same direction, or in opposite directions, to insure the homogeneity of the fuel/oxidizer mixture. The walls of the various elements of the fuel injection assembly exposed to heat and to the temperatures in the combustion chamber may have small holes 38 extending therethrough so as to provide, in known fashion, multiple cooling perforations of the walls.

Figure 6:
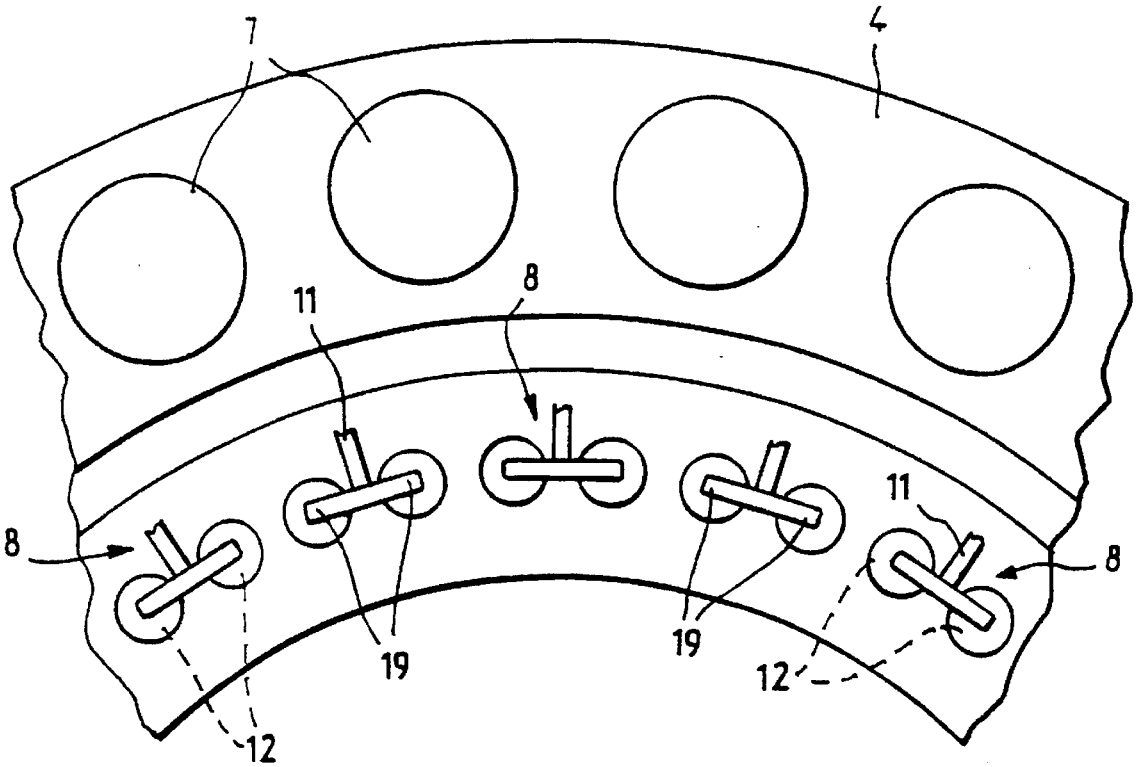
FIG. 6 is a partial end view, taken in the direction of arrow F6 in FIG. 5.
Figure 5:
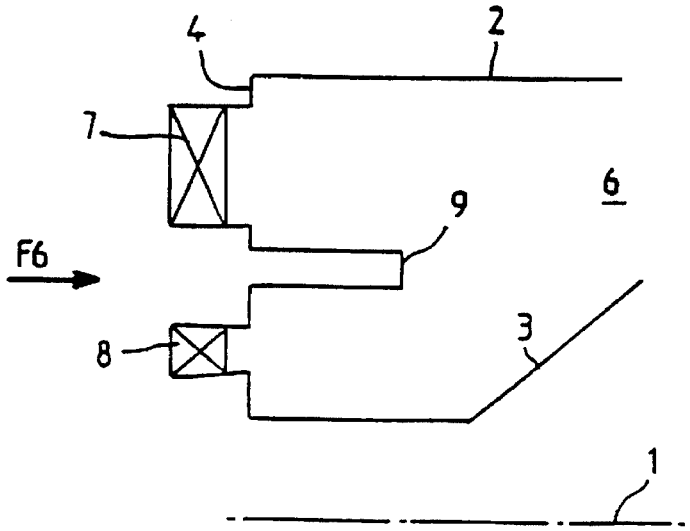
FIG. 5 is a schematic, cross-sectional view of a dual-head combustion chamber with the; inner head fitted with the fuel injection assemblies according to the present invention.
Figure 8:
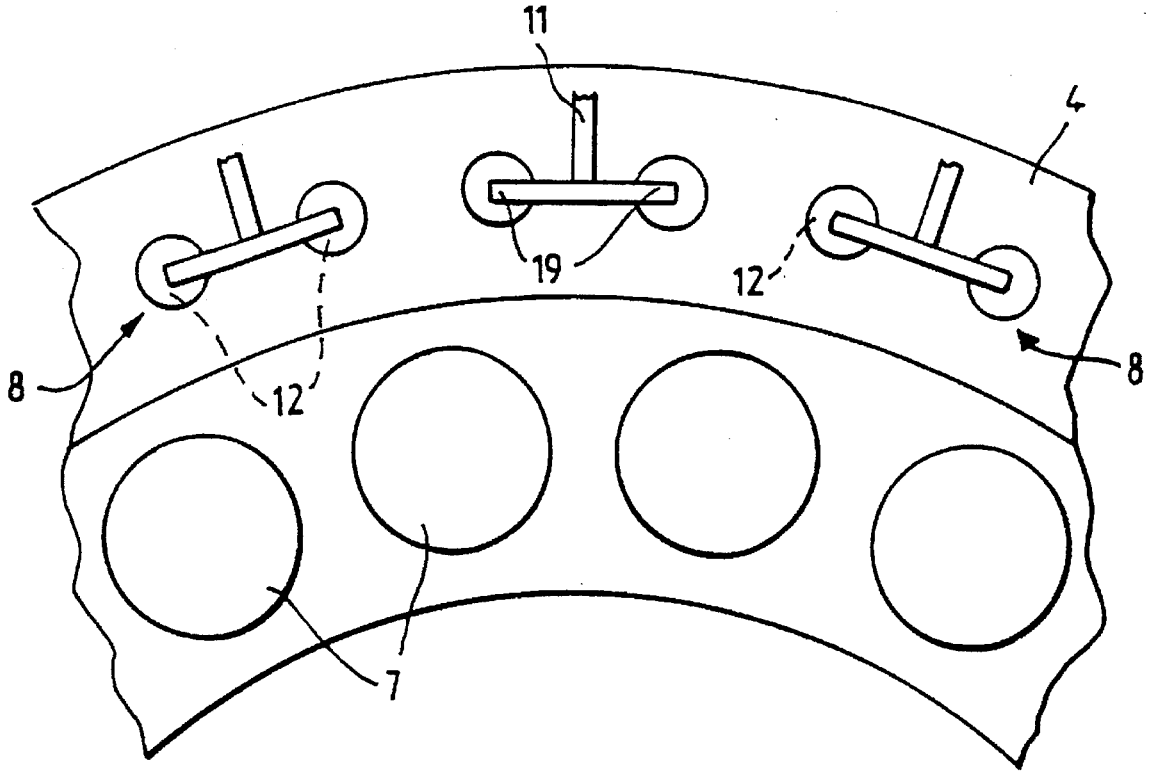
FIG. 8 is a partial, end view taken in the direction of arrow F8 in FIG. 7.
Figure 7:
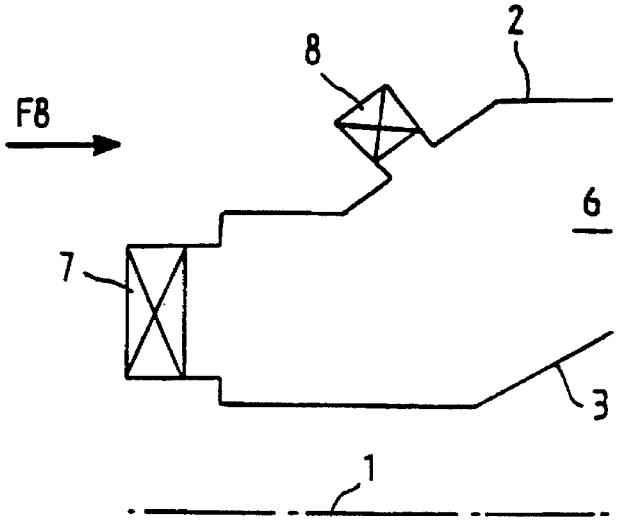
FIG. 7 is a partial, schematic, cross-sectional view similar to FIG. 5 illustrating a dual-head combustion chamber with the fuel injection assembly according to the present invention forming the radially outer head.

The incorporation of a fuel injection assembly according to the present invention into a dual-head combustion chamber is illustrated in FIGS. 5–8. FIGS. 5 and 6 disclose the use of the fuel injection assembly according to the present invention in the radially innermost head of the dual-head assembly, while FIGS. 7 and 8 illustrate the fuel injection assembly utilized in the radially outermost fuel injector head. In both of these embodiments, the fuel injection assemblies of the present invention are more compact than the known fuel injectors, since a single fuel injector supplies fuel to two intake orifices of the premixing chambers, thereby allowing optimal arrangement of the intake orifices and, hence, achieving satisfactory homogeneity of the fuel/oxidizer mixture supplied to the combustion chamber.

In both of the embodiments, the protective hood constitutes a screen protecting the fuel injector 27 and prevaporization chamber 21 from the high temperatures in the combustion chamber 6. This design reduces, or eliminates, the hot spots in the fuel injection zone and, thus, reduces or eliminates the danger of self-ignition.

The oxidizer flow, and pressure, entering the prevaporization chamber 21, as illustrated by arrow H6, and the fuel injector 27 are in such a ratio that the prevaporized fuel/oxidizer mixture in the prevaporization chamber 21 and in the prevaporization conduits 19A, 19B has a richness higher than the stoichiometric ratio. The prevaporized mixture entering the premixing chambers 12A, 12B is then agitated by the flow of dilution oxidizer passing through the swirlers 24A, 24B (124A, 124B) and by the oxidizer passing through orifices 32, 34 and 36 (arrows H2, H3, H4 and H5) and the annular spaces 18A, 18B (arrows H1), along with the oxidizer passing through the cooling perforations 38, the resulting fuel/oxidizer mixture in the premixing chambers 12A, 12B has a richness less than the stoichiometric ratio. Accordingly, the initial prevaporization, which is entirely separate from the final fuel/oxidizer mixture, allows the generation of rich prevaporized fuel/oxidizer mixtures sheltered from self-ignition and from flashbacks. The invention also permits a high-energy injection of the lean mixture from the, premixing chambers 12A, 12B into the combustion chamber 6 whereby the formation of smoke and nitrogen oxides ($NO_x$) is reduced or eliminated thereby achieve non-polluting combustion. The orientation of the intake openings 20A, 20B in the premixing chambers 12A, 12B, for the prevaporized mixture facilitates the downstream flow of the fuel/oxidizer mixture.

The converging shape of the walls 13A, 13B forming the premixing chambers 12A, 12B accelerates the fuel/oxidizer mixture towards the combustion chamber so as to insure the complete combustion of the mixture.

In the embodiment of FIG. 4, the oxidizer intake by means of the second swirlers 124A, 124B replaces the oxidizer intake through the orifices 32, 34 and 36 in the embodiment of FIGS. 2 and 3. The swirlers 24A, 24B and 124A, 124B enhance the agitation of the fuel/oxidizer mixture to assure its homogeneity, thereby insuring complete combustion within the combustion chamber 6.

Although the invention has been illustrated by having a single fuel injector 27 associated with two premixing chambers 12A, 12B, it is within the scope of this invention to combine more than two premixing chambers with a single fuel injector.

The foregoing description is provided for illustrative purposes only and should not be construed as in any way limiting this invention, the scope of which is defined solely by the appended claims.

We claim:

1. A fuel injection assembly for a combustion chamber of a gas turbine engine, the combustion chamber having an exhaust opening, the fuel injection assembly comprising:

a) a plurality of premixing chambers in communication with the combustion chamber;

b) a prevaporization chamber;

c) a fuel injector to inject fuel into the prevaporization chamber;

d) prevaporization conduits connecting the prevaporization chamber to the plurality of premixing chambers enabling fuel injected into the prevaporization chamber to pass into the premixing chambers; and, e) means to introduce oxidizer into the prevaporization chamber and the premixing chambers such that the fuel/oxidizer mixture in the prevaporization chamber has a richness exceeding a stoichiometric ratio and the fuel/oxidizer mixture in each premixing chamber has a richness less than the stoichiometric ratio.

2. The fuel injection assembly of claim 1 comprising a diaphragm opening between the prevaporization chamber and the prevaporization conduits which are connected in parallel to the prevaporization chamber.

3. The fuel injection assembly of claim 2 comprising a single diaphragm opening between the prevaporization chamber and the prevaporization conduits.

4. The fuel injection assembly of claim 1 wherein each premixing chamber has an intake orifice communicating with a prevaporization conduit.

5. The fuel injection assembly of claim 1 further comprising a protective hood between the fuel injector and the combustion chamber to prevent self-ignition of the fuel/oxidizer in the prevaporization chamber.

6. The fuel injection system of claim 5 wherein each premixing chamber is bounded by a wall such that portions of adjacent walls form part of the protective hood.

7. The fuel injection system of claim 6 wherein an end of the protective hood and the prevaporization chamber define an opening therebetween to enable oxidizer to pass into the protective hood and into the prevaporization chamber.

8. The fuel injection system of claim 7 wherein the portions of the premixing chamber walls forming a part of the protective hood have orifices enabling oxidizer in the protective hood to pass into the premixing chambers.

9. The fuel injection system of claim 1 further comprising at least one helical intake oxidizer swirler located coaxially with an intake orifice of each premixing chamber.

10. The fuel injection system of claim 1 further comprising two helical intake oxidizer swirlers located coaxially with an intake orifice of each premixing chamber.

11. The fuel injection system of claim 6 wherein the wall bounding each premixing chamber is generally tubular.

12. The fuel injection system of claim 11 wherein each wall has at least one dilution orifice to enable oxidizer to pass into the premixing chamber.

13. The fuel injection system of claim 11 wherein the generally tubular wall converges in a direction toward the exhaust opening of the combustion chamber.

14. The fuel injection system of claim 13 wherein the wall is generally frusto-conical in configuration.

* * * * *